United States Patent [19]

Ohta

[11] 4,052,066

[45] Oct. 4, 1977

[54] LIGHT-EMISSION GUN AMUSEMENT MACHINE FOR HOME USE

[75] Inventor: Takao Ohta, Hirakata, Japan

[73] Assignee: Nintendo Co., Ltd., Kyoto, Japan

[21] Appl. No.: 659,553

[22] Filed: Feb. 19, 1976

[30] Foreign Application Priority Data

Dec. 31, 1975 Japan ..... 51-158430

[51] Int. Cl.[2] ..... F41J 5/02; F41J 5/06

[52] U.S. Cl. ..... 273/101.1; 273/102.1 B; 273/102.2 B

[58] Field of Search ..... 35/25; 273/101.1, 101.2, 273/102.2 B, 102.1 B

[56] References Cited

U.S. PATENT DOCUMENTS

| | | | |
|---|---|---|---|
| 2,161,012 | 6/1939 | Breitenstein et al. | 273/101.1 |
| 2,392,142 | 1/1946 | Gosswiller | 35/25 |
| 2,467,180 | 4/1949 | Anderson | 273/101.1 |
| 2,662,305 | 12/1953 | Alric | 35/25 |
| 2,957,695 | 10/1960 | Arizpe | 273/101.1 |
| 3,146,665 | 9/1964 | Domeshek et al. | 35/25 X |
| 3,892,352 | 7/1975 | Eglin | 35/25 X |
| 3,904,204 | 9/1975 | Yokoi | 273/101.1 |

*Primary Examiner*—Anton O. Oechsle
*Assistant Examiner*—Vance Y. Hum
*Attorney, Agent, or Firm*—Wenderoth, Lind & Ponack

[57] ABSTRACT

A compact light-emission gun amusement machine for home use, comprising a light source, a screen, a mirror as disposed between the screen and light source, the angle of reflection of the mirror being variable to project a moving mark on said screen, a light-emission weapon and a novel hit indicating device in a novel combination. The hit indicating device includes a mirror vertical drive mechanism connected to a driving shaft driven by an electric motor and a mirror horizontal drive mechanism which is associated with the driving shaft in such relation that the former is driven only when the latter is driven in a reverse direction. Thus, as the motor is driven in a normal direction, the mark is caused to move in a composite direction made up of horizontal and vertical components to simulate a flight of a winged creature, while as the same motor is driven in reverse, the horizontal drive of the mirror is suspended to cause the mark to move in a vertically downward direction only across the screen to simulate a fall of the creature shot by the weapon.

6 Claims, 19 Drawing Figures

LIGHT-EMISSION GUN AMUSEMENT MACHINE FOR HOME USE

BACKGROUND OF THE INVENTION

The present invention relates to a light-emission gun amusement machine of a type wherein a moving luminous mark projected on a screen is shot at by a marksman with a light-emission weapon. More particularly, the present invention relates to a shooting system including a light source, a screen, a mirror as interposed between the light source and the screen, the angle of reflection of the mirror being variable both horizontally and vertically, a light emission weapon and a hit indicating device including a photosensor element, wherein a beam of light projected on the screen is moved along X- and Y- axes to produce a luminous mark moving diagonally across the screen so that a marksman may shoot at the mark with the light-emission weapon.

A shooting system of this general type is described in the prior art. The prior art teaches an elaborate system wherein a successful shot at the mark is indicated by the cancellation of the mark, projection of a falling mark on the screen, and an electrically controlled indication of the hitting light and sound emissions and so forth. However, the use of such electronic circuitry of necessity resulted in a high degree of complexity of the entire system and the combined provision of a target mark projection unit and a hit mark projection unit made the apparatus too costly and bulky for home amusement purposes. If fact, the simulating machine according to this invention can be manufactured and made available at a cost less than about one-tenth of the prior art equipment designed to perform the functions of the present machine. Compactly built, the light-emission gun amusement machine of the present invention is definitely intended for home amusement purposes and, yet, has several additional advantages over the prior art larger machines as will be understood from a perusal of this specification. For example, the aforementioned problem of complexity has now been deftly solved by employing an arrangement such that a mirror horizontal drive mechanism and a mirror vertical drive mechanism for moving a luminous target mark across a screen is driven by a single electric motor and an indication of a successful shot is controlled by the reverse rotation of the very single electric motor that, as aforesaid, drives the mirror drive mechanisms.

SUMMARY OF THE INVENTION

It is, therefore, an object of this invention to provide an inexpensive, yet highly sophisticated light-emission gun machine for home amusement purposes. Another object of the invention is to provide a compact light-emission gun amusement machine which, excepting the weapon, e.g. a pistol, measures not more than about 30 by 20 by 15 centimeters and which, yet, permits a realistic and fascinating field practice.

This invention is, therefore, directed to:

A light-emission gun amusement machine including a light source, a screen, a mirror interposed therebetween to refect the light beam from the light source onto said screen and thereby to produce a target mark thereon, which comprises a mirror drive system consisting of a mirror vertical drive mechanism including a driving shaft connected to a constantly revolving shaft connected to an electric motor in such a manner that the mirror is kept tilting back and forth throughout the rotation of the electric motor and a mirror horizontal drive mechanism including a driving shaft disconnectably associated with the constantly revolving shaft via a one-way clutch operable only in a normal direction of the motor, whereby the mirror is driven horizontally only during the rotation in normal direction of the electric motor, and a motor power supply control device including a switching mechanism for reversing the electrical connection between the motor and a power supply upon generation of an output signal by a photosensor element to reverse the rotational direction of the electric motor, whereby said target mark is caused to move diagonally in a composite direction made up of horizontal and vertical component directions on the screen by and during a normal rotation of the motor to simulate a flight of a prey and the mark is caused to move only vertically downwardly upon suspension of the horizontal drive of the mirror as the motor is driven in reverse in response to the generation of the output signal to thereby simulate a fall of the prey.

BRIEF DESCRIPTION OF THE INVENTION

Figure 16A:
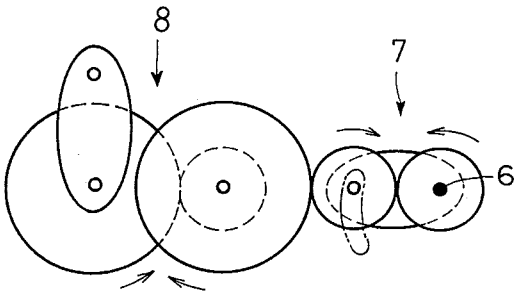
Figure 16B:
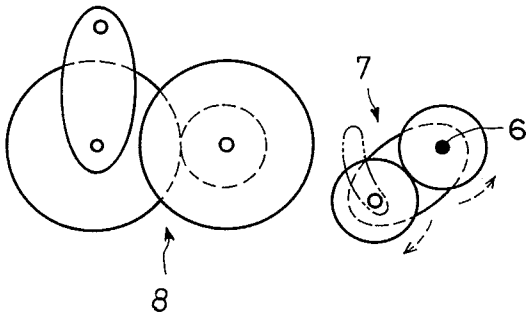
Figure 17:
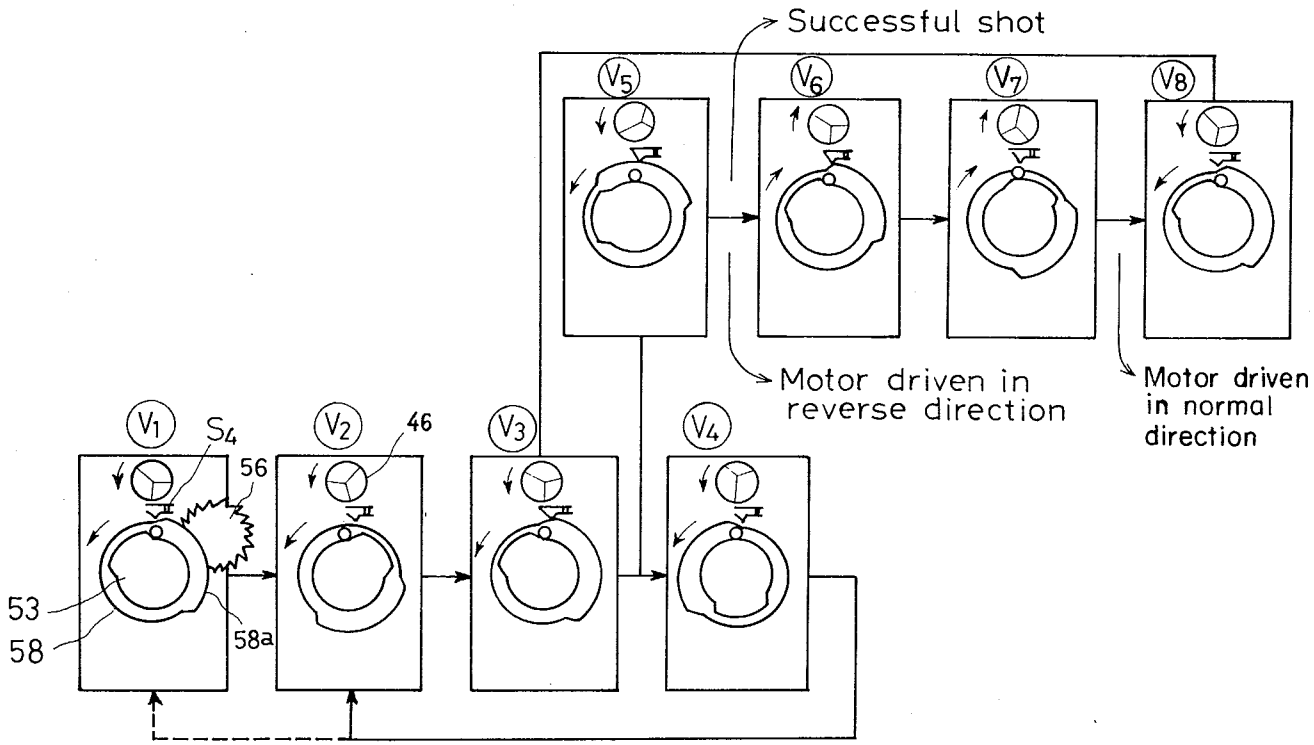
Figure 18:
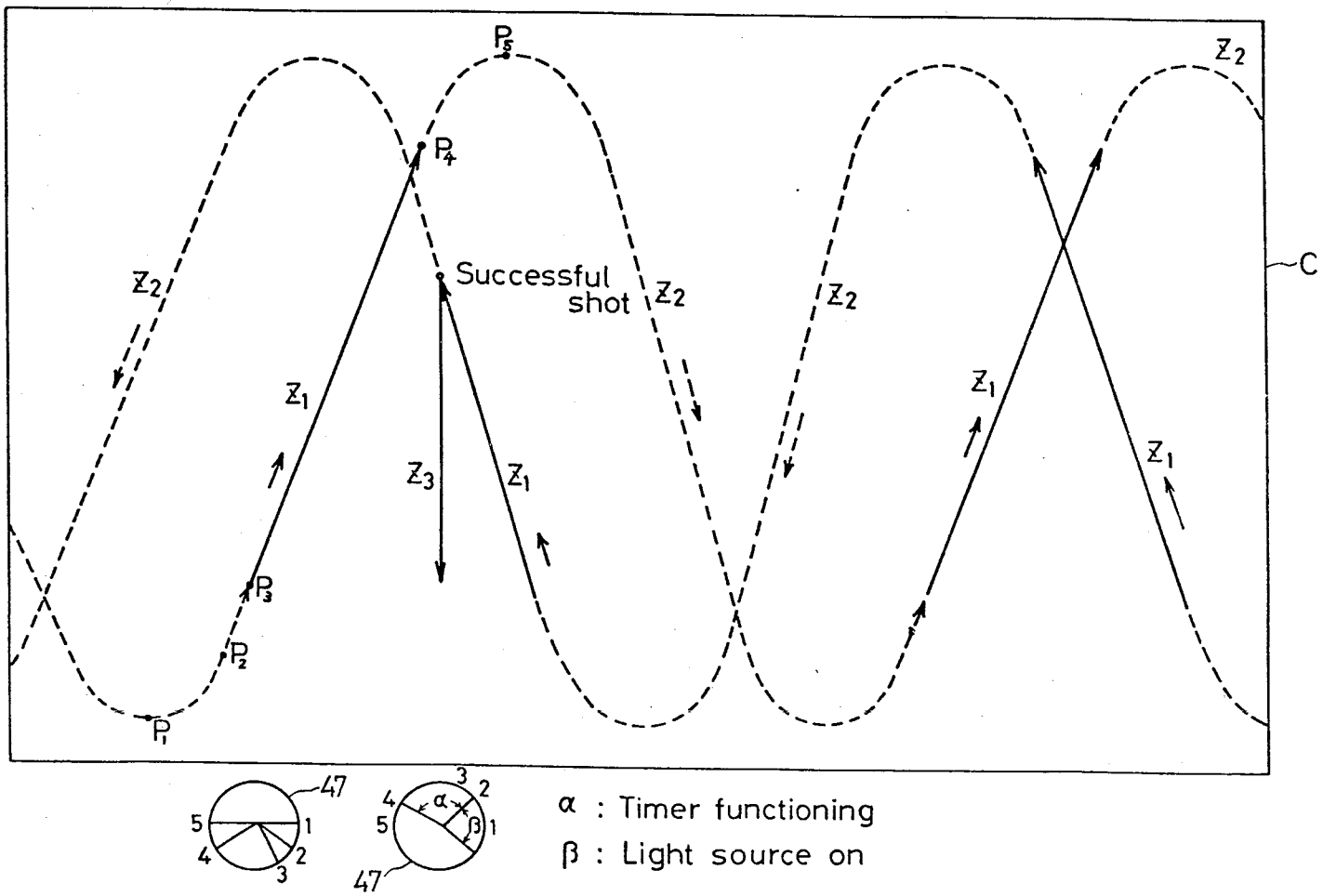

FIGS. 16*a* and 16*b* are plan views illustrating the functioning of the one-way clutch interposed between the mirror horizontal drive mechanism and the revolving shaft of the amusement machine, wherein *a* indicates the power-transmitting position (normal rotation of the motor) and (*b*) indicates the non-transmitting position (reverse rotation of the motor);

FIG. 17 is a schematic view showing the functioning of the target mark cam of the switching mechanism for controlling the mark-lighting and motor power supply functions in accordance with this invention; and FIG. 18 is a schematic view showing the flight path of the target mark wherein the unbroken line $Z_1$ signified a a normal flight, the broken line $Z_2$ indicates that the light source is off and the mark does not exist, and the unbroken line $Z_3$ represents a fall of the mark.

DETAILED DESCRIPTION OF THE PREFERRED EMBODIMENT

Figures 1, 2:
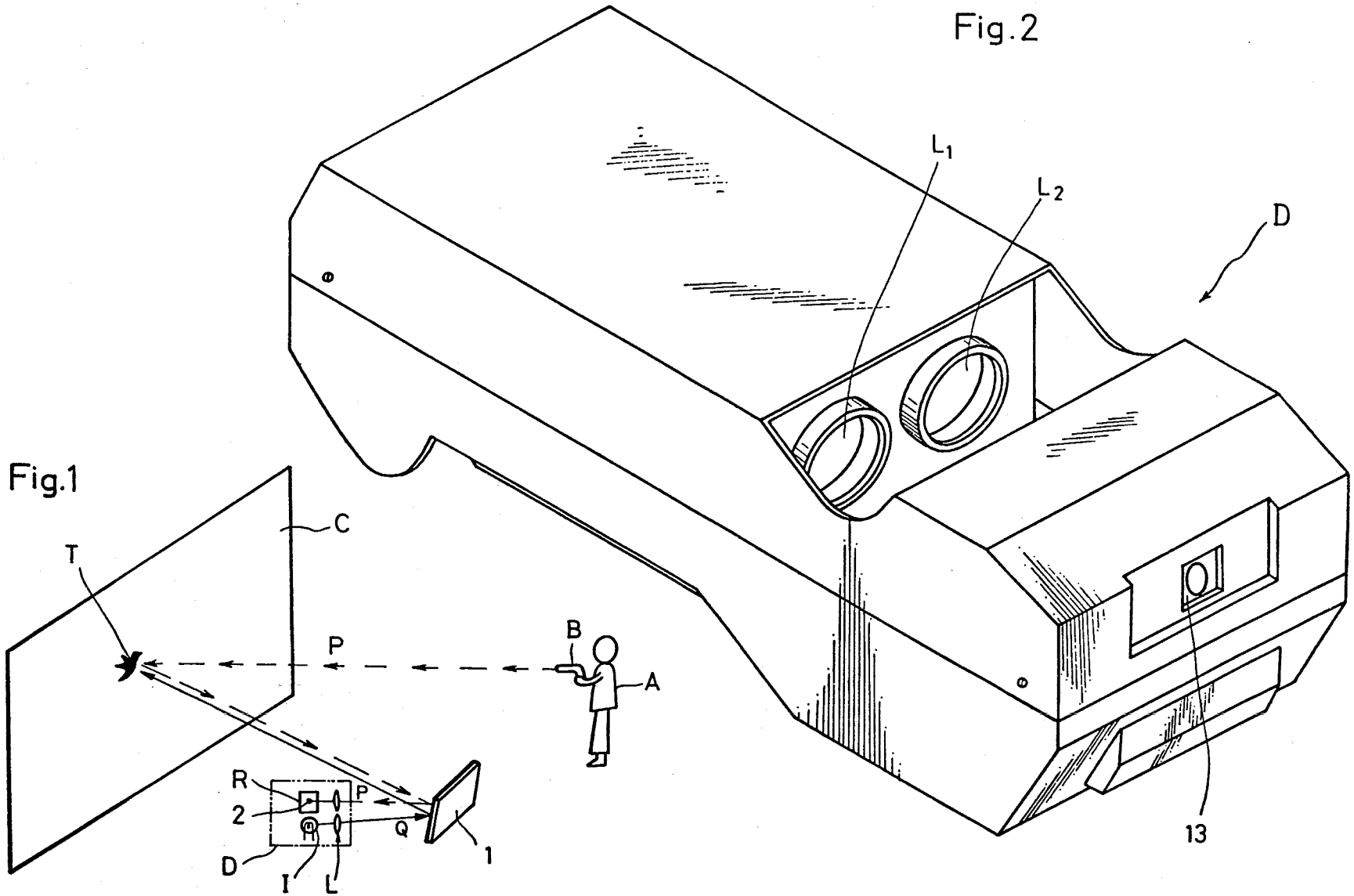
FIG. 1 is an elementary sketch showing an embodiment of the light-emission gun amusement machine according to this invention.
FIG. 2 is a perspective view showing a target mark-generating and hit-indicating unit of the machine.
Figure 3:
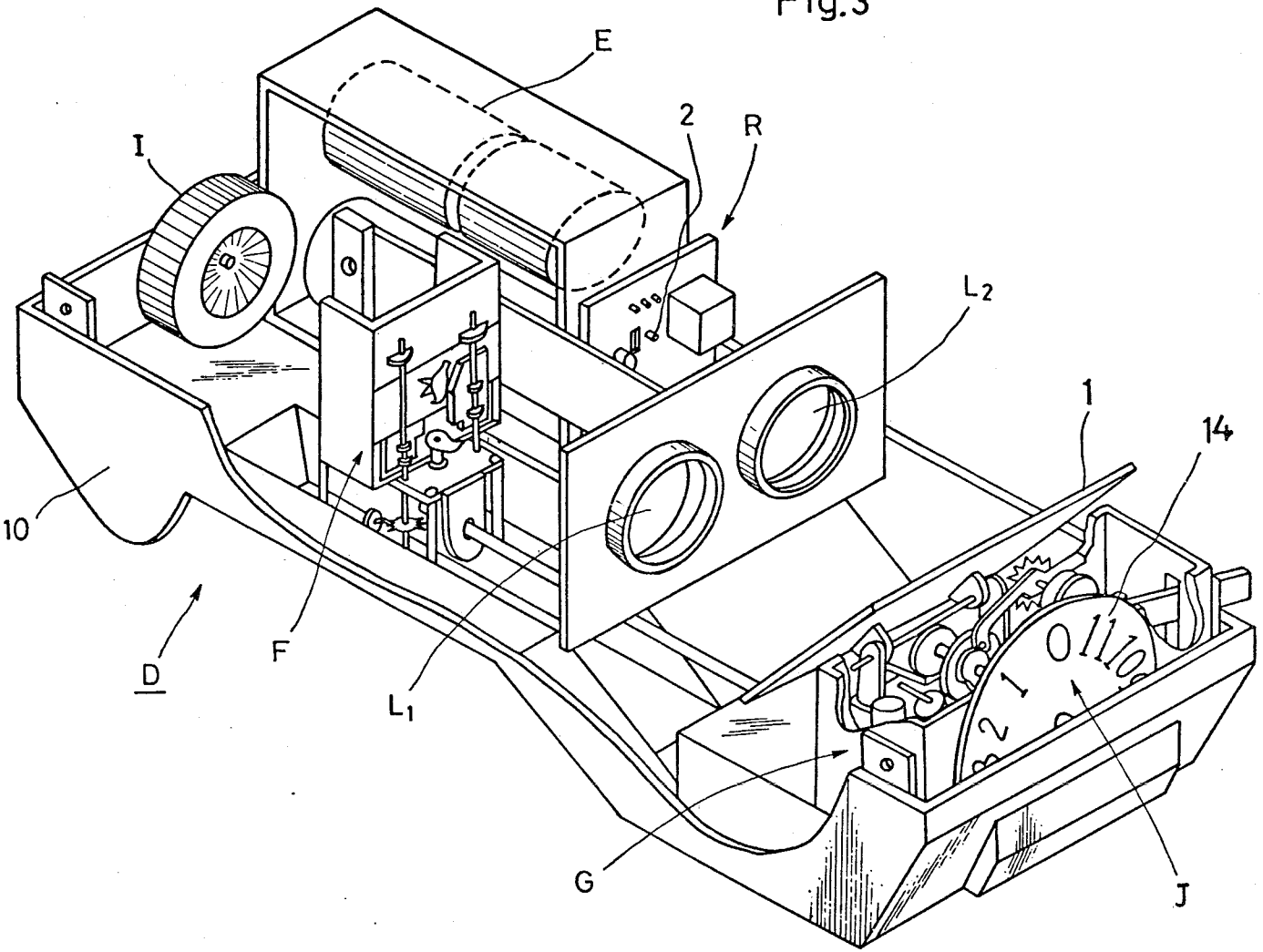
FIG. 3 is a perspective view showing the inner mechanism of the unit with the top cover removed.
Figure 4:
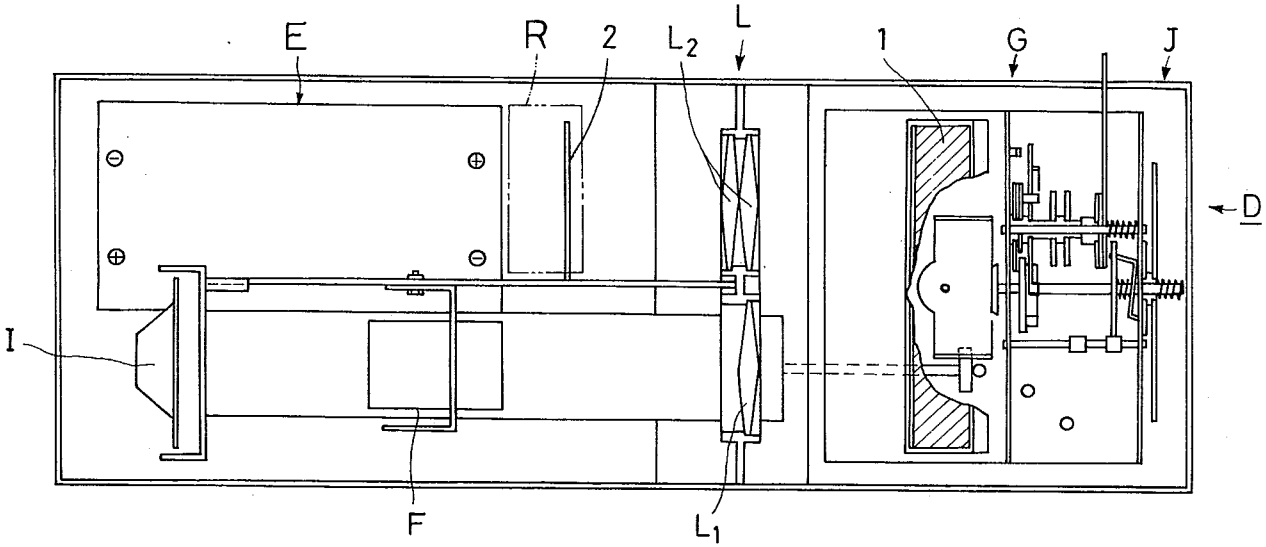
FIG. 4 is a plan view of the same unit.
Figure 5:
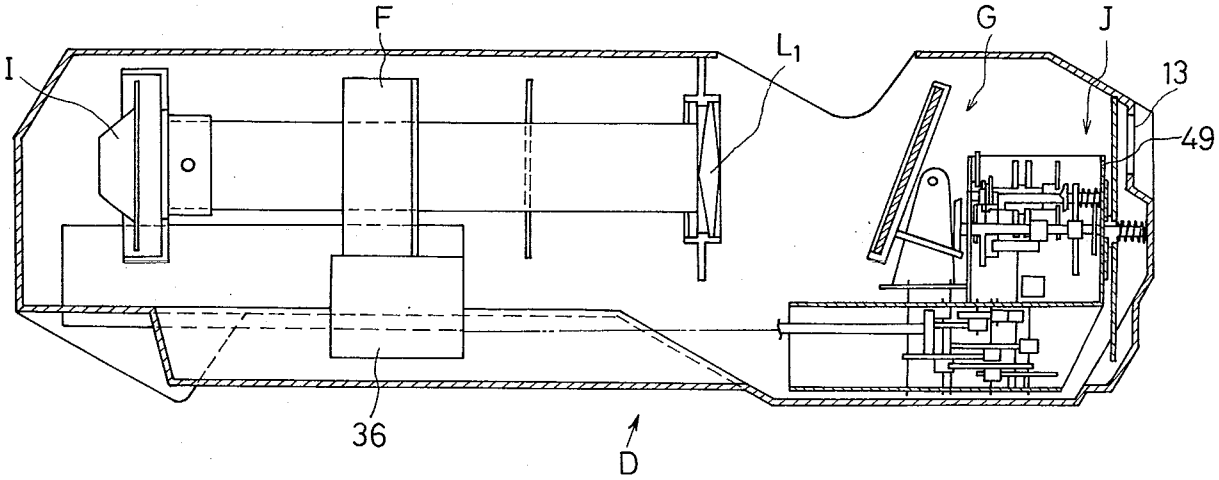
FIG. 5 is a side-elevation view of the unit.
Figure 9:
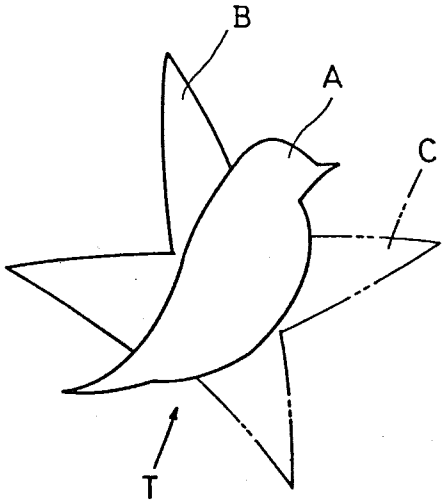
FIG. 9 is a schematic view showing the varied configurations of the target mark.
Figure 6:
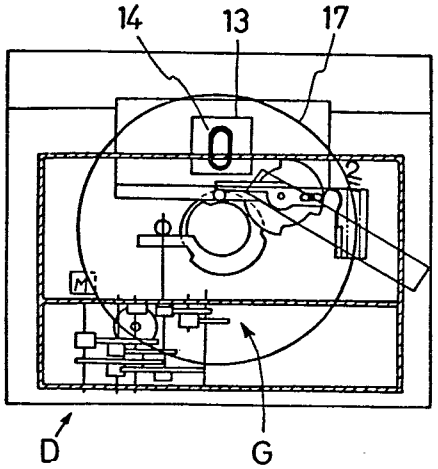
FIG. 6 is a side-elevation of the same.

FIG. 1 is a schematic view showing a light-emission gun amusement apparatus which comprises a light-emission weapon B held by a marksman A, a screen C adapted for mounting on the wall of a room, and a target mark-forming and hit-display unit D. The last-mentioned unit D comprises, as built into a housing as shown in FIGS. 2 to 6, a power supply E, a light source I, a diaphragm unit F, a lens system L, a mirror 1, a mirror drive unit G and a hit signal generating unit R including a photoelectric element 2 which generates an output signal upon incidence of light, such as a solar cell or a phototransistor element. Thus, the light beam from the light source 1 passes the diaphragm unit F and lens $L_1$), is reflected by mirror 1, and forms a luminous mark I on screen C. If the marksman hits the target mark, the light P from the light-emission weapon B is reflected by screen C and this reflected light is again reflected by the mirror I. The light thus reflected by mirror I passes through a lens $L_2$ which focuses the light on the photosensor element 2, whereupon the hit signal generating unit R is actuated to generate a hit signal and drives the hit display unit. The mirror drive unit G is such that the rotation of an electric motor M is transmitted through a speed-reducer to a driving shaft 6 which, via a one-way clutch 7 and a transmission gearing 8, drives a driving shaft 4 of a mirror horizontal drive mechanism H and, via a transmission gearing 9, a driving shaft 3 of a mirror vertical drive mechanism V, whereby the horizontal and vertical tilting angles of the mirror 1 are changed with respect to the incident light Q from said light source 1 to cause the target mark on screen C to move diagonally across the screen as a composite of its horizontal and vertical movements, thus producing a simulated winged prey or other target in flight.

The mirror horizontal drive mechanism H will first be described in detail. The mirror 1 is rotatably mounted on a shaft 41 across the tops of a pair of upright extensions 40*a*, 40*a* of a support plate 40 which is rotatably mounted on a shaft 42 at the center of a horizontal base 40*b* thereof so that a horizontal extension 40*c* of plate 40 is free to swing in a lateral direction. The horizontal extension 40*c* has a longitudinally extending slot 43, and an arm 44 is rigidly secured to the top of the revolving shaft 4 driven by motor M via the driving shaft 6, one-way clutch 7 and transmission gearing 8. Rigidly secured to the forward end of the arm 44 is a pin 45 which, in turn, engages the slot 43 so that the support plate 40 is swung in a horizontal plane in response to the revolution of shaft 4 via the arm 44 and pin 45 and, accordingly, the angle of reflection of light Q from mirror 1 is varied to cause the target mark I to move horizontally across the screen C. The construction of the mirror vertical drve unit V is such that an eccentric cam 46 rigidly secured to the forward end of a driving shaft 3 driven by motor M via driving shaft 6 and transmission gearing 9 abutts against a plate 48 having an arcuate face 47 which projects from the lower part of the reverse side of the mirror 1 so that, in response to the revolution of driving shaft 3 via eccentric cam 46 and plate 48 associated therewith, the mirror 1 is swung forward and backward in the direction of arrowmark Y about the shaft 4 to vary its angle of inclination with the perpendicular and, thereby, to cause the target mark I to move in a vertical direction across the screen C.

Figure 7:
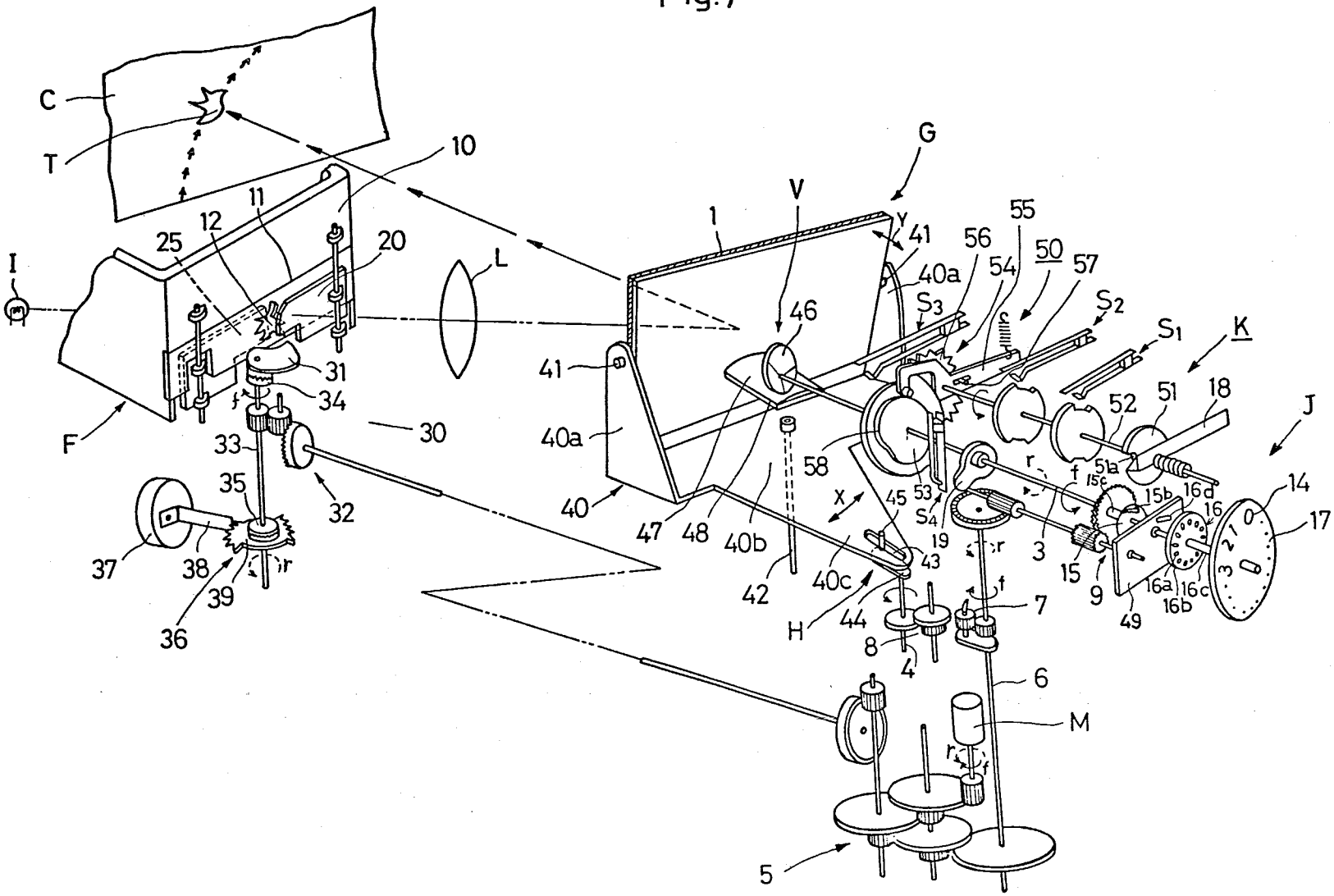
FIG. 7 is an exploded perspective view showing the internal mechanism of the unit.

Referring to FIG. 7, J indicates a device for displaying a cummulative number of successful shots, which is constructed so that, the rotation of an indexing unit 16 driven through a one-way clutch on reverse revolution of a driving shaft 3 causes a display plate 17 to advance by one step or graduation to add one unit to the score displayed in a window (13) formed in a wall of housing 10. The indexing unit 16 is so constructed that a disc 16*b* having the same number of perforations 16*a* as the figures or numerals of the display plate 17 is integrally connected to display plate 17 via a cylinder 16*c*, and a side plate 49 rigidly secured to housing 10 is provided with a large elongated opening 16*d* corresponding to an adjacent couple of two perforations of disc 16*b* so that on normal revolution of shaft 3, a pawl 15*b* of clutch plate 15*a* of the one-way clutch 15 retracts inwardly from the elongated opening 16*d* and fails to act upon the disc 16*b* but when the shaft 3 is driven in a reverse direction, the pawl 15*b* under the tension of a spring 15*c* projects through elongated opening 16*d* to engage the perforation 16*a* of disc 16*b* and, thereby, rotates the disc 16*b* and display plate 17 by a distance equal to the length of elongated opening 16*d*, thus adding one unit to the score displayed in the window 13.

Figure 10:
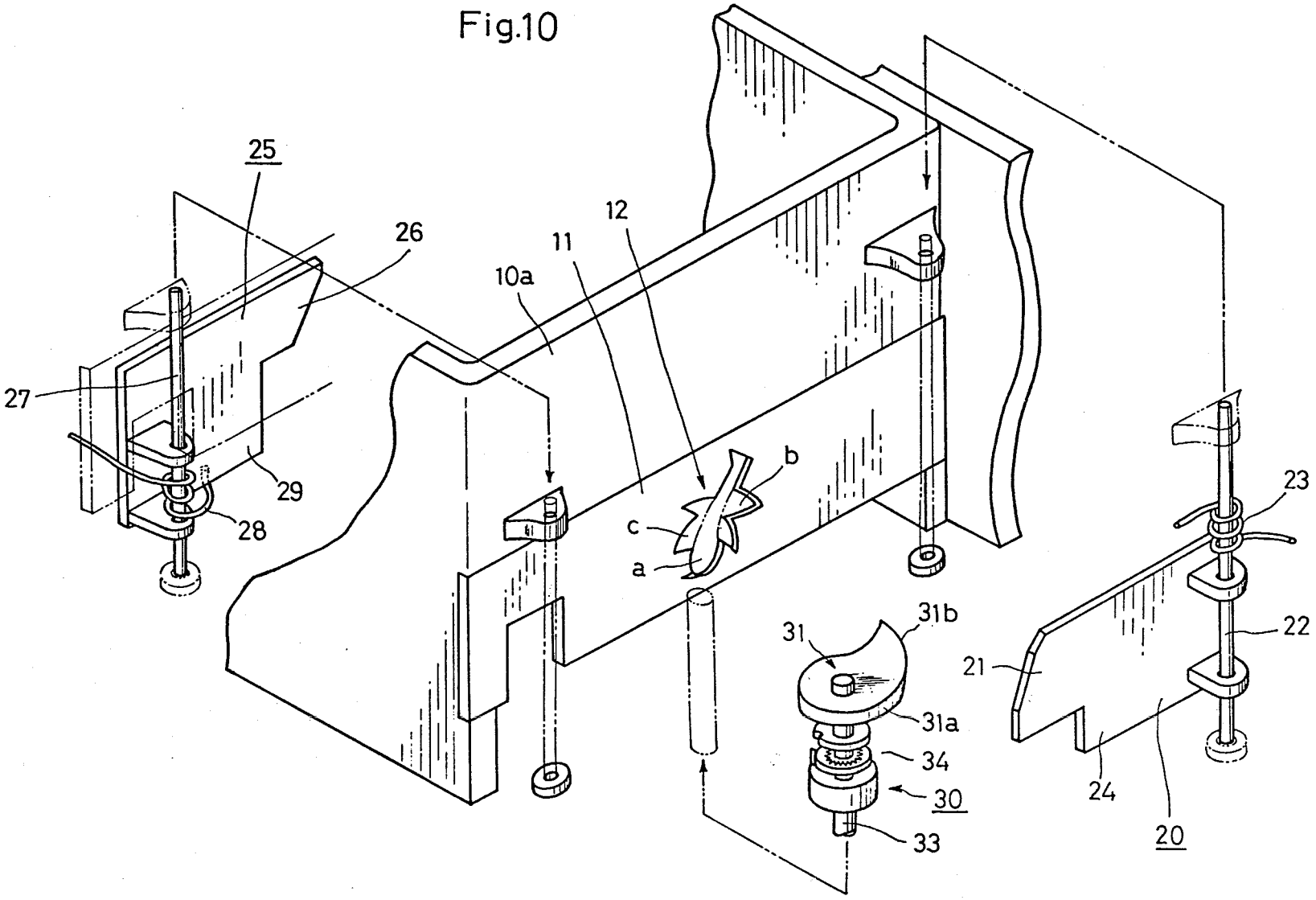
FIG. 10 is an exploded perspective view showing the diaphragm device employed in the light-emission gun amusement machine according to this invention.
Figure 12:
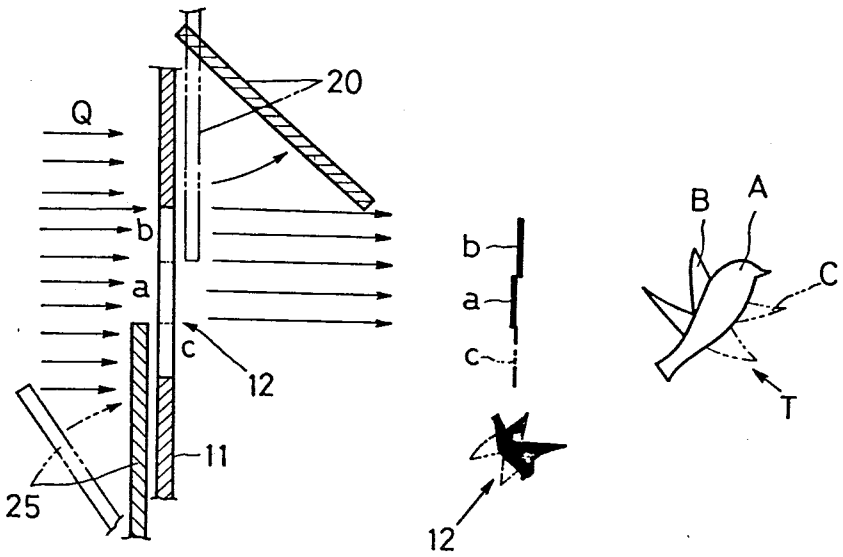
FIG. 12 is a schematic view showing the changes in configuration of the target mark in response to the pivotal movement of the diaphragm member plates.
Figure 11:
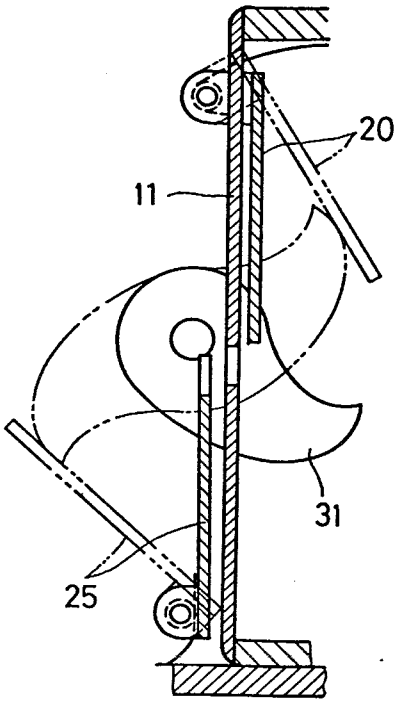
FIG. 11 is a schematic view showing the pivotal movement of the movable diaphragm member plates of the diaphram device.

Referring to FIG. 10, the 'diaphragm' unit F comprises a stationary plate 11 rigidly secured to frame 10*a*, a first movable diaphragm member plate 20 rotatably mounted on a vertically-extending shaft 22 secured to frame 10*a*, a second movable diaphragm member plate 25 rotatably mounted on frame 10*a* via a vertically-extending shaft 27 in juxtaposition with the first movable diaphragm member plate 20 and a diaphragm alternating drive mechanism 30 adapted to drive the two movable diaphragm member plates 20 and 25 in turn.

The stationary plate 11 includes a mark aperture 12 in the path of light Q, the mark aperture 12 consisting of a basic configured area *a*, a first extension configured area *b* and a second extension configured area *c*, the latter two areas *b* and *o* being located on both sides of the basic area *a*. The said mark aperture 12 causes the light from light source 1 to be restricted to its configuration. The first movable diaphragm meinber plate 20 has a shutter portion 21 for blocking the light incident from the mark aperture 12 of stationary plate 11 and is preenergized by spring 23 passed over shaft 22 toward the stationary plate 11. Thus, when the diaphragm member plate 20 is brought into superimposition on the stationary plate 11, the shutter portion 21 of plate 20 covers the front of the first extension configured area *b* of the mark aperture 12. At the lower end thereof, the first movable diaphragm member plate 20 has an engaging portion 24 adapted to engage a cam 31 of a diaphragm plate driving unit 30.

Like the first movable diaphragm member plate 20, the second movable diaphragm member plate 25 includes a second shutter portion 26 and an engaging portion 29, and is preenergized by spring 28 toward the stationary plate 11. Thus, as the plate 25 comes into superimposition on the stationary plate 11, the second shutter portion 26 blocks the front of second extension configured area *c*.

Figure 15:
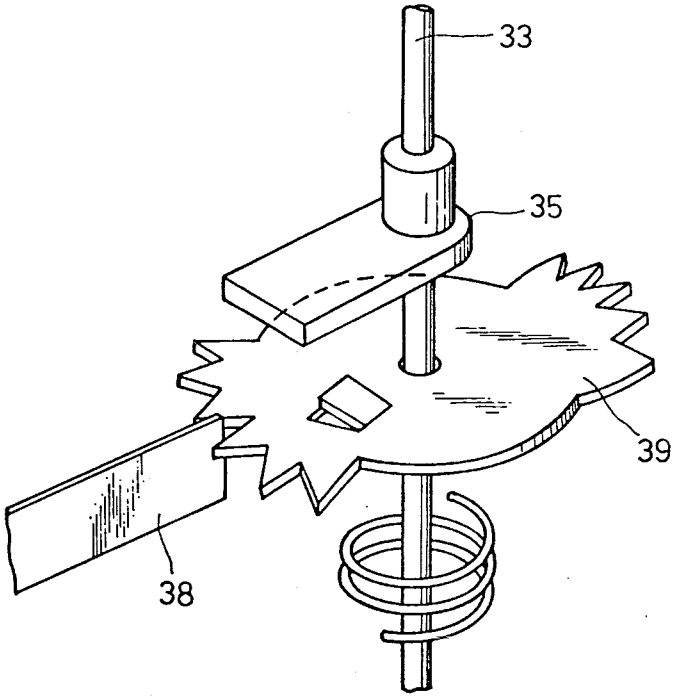
FIG. 15 is a perspective view showing an example of the one-way clutch used in association with the hitting-sound emission device incorporated in the light-emission gun amusement machine of this invention.
Figure 14:
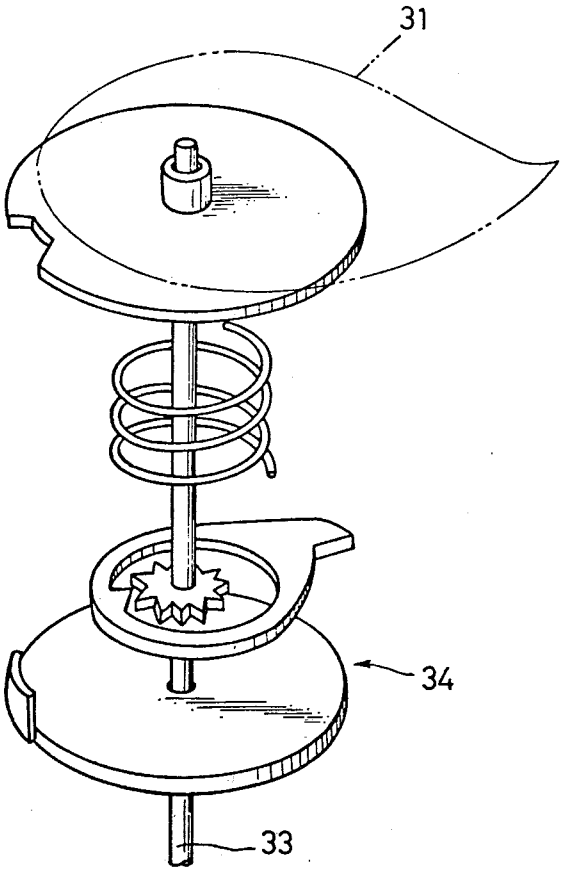
FIG. 14 is a perspective view showing an example of the one-way clutch of the diaphragm drive mechanism used for the diaphragm device.

The aforementioned diaphragm plate driving unit 30 is so designed that the cam 31 is loosely mounted at the upper end of a constant-revolving shaft 33 driven by motor M via a transmission mechanism 32, the revolving shaft 33 and cam 31 being connected by a one-way clutch 34 in a power transmitting relation (See FIG. 14). Furthermore, a sound-emission apparatus adapted to produce a simulated cry of the prey or other sound effect upon successful shooting is connected to the lower end of the revolving shaft 33 via a one-way clutch 35 which is actuated when the shaft 33 is driven in a reverse direction. The aforementioned sound-emission apparatus (36) is so designed that a vibrating member 38 one end of which is secured to a resonance box 37 is positioned in engagement with a partially serrated plate 39 rigidly secured to the driven side of one-way clutch 35 so that as the one-way clutch 35 is actuated, the serrated plate 39 rotates to drive the vibrating member 38 which emits a simulated cry of the wounded prey or other sound effect as mentioned above. FIG. 15 shows an example of the one-way clutch designed to function on the aforesaid reverse mode of drive.

Figure 8:
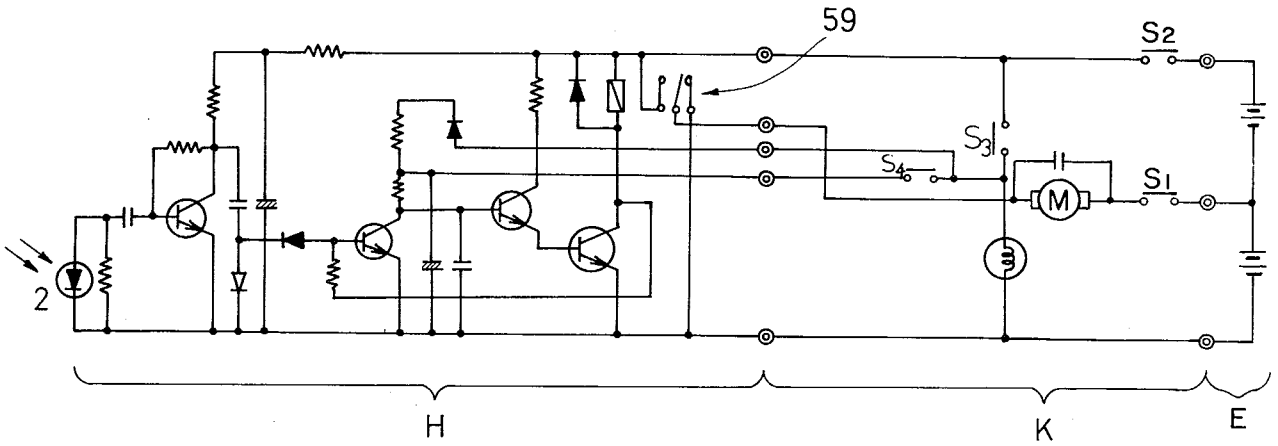
FIG. 8 is an electric circuit diagram showing the control system for the electric motor and target mark-generating light source of the amusement machine according to this invention.

Referring to FIG. 7, K is a switching mechanism for mark projecting control and motor power supply control. This mechanism K comprises a motor main switch $S_1$, a light source switch $S_2$, a light source control switch $S_3$ and a reset switch $S_4$, all connected as shown in FIG. 8, as well as a game start lever 18 and a game time control mechanism 5Q. The reset switch $S_4$ is driven by a cam 19 which, in turn, is driven in timed relation with one-way clutch 15, and is turned ON at the moment an increased score is displayed by the score display unit J upon reverse rotation of the motor in response to a successful shot, so that the motor M will be immediately caused again to run in a normal direction. The game time limiting mechanism 50 is so constructed that a control shaft 52 carrying, as rigidly mounted thereon, a starter cam 51 having a notch 51*a* adapted to engage the game start lever 18 is associated in operative relation with the drive shaft (3) via a mark cam 53 and a mark flight counter 54 so that the starter cam 51 will complete one revolution when the number of revolutions of mark cam 53 has reached a predetermined number. The game is over when starter cam 51 has completed one revolution. The mark flight counter 54 comprises a movable member 55 which completes one vertical reciprocating movement in response to one revolution of the mark cam 53, a counter plate 56 rigidly secured to shaft 52, and a pin 57 such that, in response to one vertical reciprocating movement of the movable member 55, it makes one transverse reciprocating movement to rotate the counter plate 56 by an angle corresponding to one tooth thereof.

In starting the game, upon shift of the starter lever 18, the swithes $S_1$, $S_2$ and $S_3$ are closed to turn on the light source I, whereupon the mark is displayed on the screen C and, at the same time, the electric motor M is started in a normal direction as indicated by arrow mark *f* in FIG. 7. As the motor is thus started, the mirror horizontal drive mechanism H, mirror vertical drive mechanism V and diaphragm drive mechanism 30 are also simultaneously driven so that the mark on the screen C is caused to move in a composite direction made up of X-axis and Y-axis components and, thereby, simulate a flight of a prey such as a bird. As will be described in detail below, the mark is varied in shape by the diaphragm mechanism.

The mirror vertical drive mechanism V causes the mark not only to ascend but also to descend and the path Z of flight of the mark includes the path component indicated by solid line $Z_1$ and the path component indicated by broken line $Z_2$ (See FIG. 18). However, the light source 1 is switched on only when a cam face 58*a* of the cam timer 58 rigidly mounted on driving shaft 3 is brought into contact with switch $S_3$. The cam face 58*a* exists only in the position $\beta$-section of an eccentric cam 46 where the projected mark is in an ascending position, and does not exist, and, hence, does not actuate switch $S_3$, in any position of eccentric cam 46 other than said $\beta$-section. Therefore, of the fight path of the mark, the component indicated by broken line $Z_2$ does not actually exist but the mark appears on the screen only during its ascending flight, thus making it difficult for the marksman to anticipate the starting point of the next flight.

Furthermore, upon fall of the mark, which will be described hereinafter, the angular relation of eccentric cam 46 and arm 44 is altered so that the next ascending flight will start where the point of fall of the mark, thus making the flight path more complicated. Therefore, flights will substantially never be repeated in the same path.

Upon a successful shooting by the marksman at the mark moving in the flight path $Z_1$, an output signal is generated by a photosensor element 2 to drive the hit signal generator unit H which actuates the relay 59 to reverse the rotation of motor M. Upon reverse rotation of the motor, the revolving shaft 33 driving shaft 6 and driving shaft 3 are driven in reverse as shown by arrow mark *r* in FIG. 7, whereby the aforementioned sound is emitted, the hit display unit J operates, the mirror horizontal drive mechanism H is arrested as the oneway clutch 7 suspends the transmission of motor output to driving shaft 4, and the vertical drive mechanism V is reversed so as to cause the mark to descend vertically in the direction of Y-axis only and, therefore, to simulate a fall of the prey down the screen C. Thus, irrespective of the height of the mark on the screen, the mark starts falling simultaneously with a sucessful shot.

The shot also drives the display plate 17 to add one unit to the score.

Every time the mark ascends once, the movable plate 55 completes one reciprocating movement to rotate the counter 54 by one tooth. As the counter 54 completes one revolution, the starter cam 51 also completes one revolution, whereupon the end of the starter lever 18 engages the notch 51*a* to arrest revolution of shaft 52. At this moment, the switches $S_1$ and $S_2$ are opened to stop the electric motor M and turn off the light source, the game being thus over. FIG. 17 shows the relation of the mark cam 53, the eccentric cam 47 for mirror vertical drive, and the switch $S_3$ in the above function. The symbol $V_1$ means the start and end of a game, $V_2$ the start of functioning of the timer, $V_3$ the end of functioning of the timer and the switching-on of the light source I, and $V_4$ the switching-off of light source I. Where there occurs no successful shot at all, a predetermined number of projections of the mark take place as $(V_1 \rightarrow V_2 \rightarrow V_3 \rightarrow V_4) \rightarrow (V_2 \rightarrow V_3 \rightarrow V_4) \rightarrow (V_2 \rightarrow V_3 \rightarrow V_4)$ - - - and, then, resetting to $V_1$ occurs. If there is a successful shot between $V_3$ to $V_4$, i.e. $V_5$, the sequence is changed to the mode shown in the upper row of FIG. 17. The symbol $V_5$ indicates the mark in flight on the screen. $V_6$ means the start of functioning of the timer, the start of operation of the counter and the switching-off of the light source, $V_6$ and $V_7$ mean the completion of operation of the counter, and $V_8$ is the completion of functioning of the timer and the switching on of the light source. The mode is changed from $V_8$ over to $V_2$.

Figure 13:
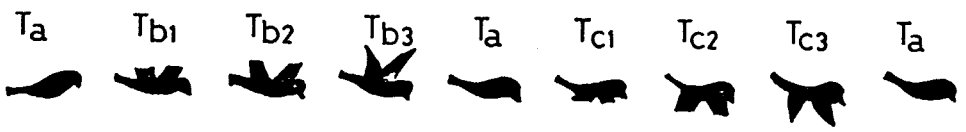
FIG. 13 is a schematic view showing the changes in configuration of the mark.

The following description pertains to the changes in configuration of the mark in flight. When both the first movable diaphragm member plate 20 and the second movable diaphragm member plate 25 are superimposed on the stationary plate 11, the light beam from the light source is permitted to pass through the basic configured area *a* of mark aperture 12 so that the mark on the screen has a basic form indicated by symbol A. However, as the first movable diaphragm member plate 20 rotates in response to the revolution of cam 31, the light is allowed to pass through part or all of the first extension configured area B as well as the basic configured area A and, accordingly, the mark on the screen is a composite of areas A and part or all of area B. Then, as the second movable diaphragm member plate 25 is similarly driven, the resultant mark will be composite of said basic configured area A and part or all of the second extension configured area C. Thus, as illustrated in FIG. 13, the configuration of the mark on the screen varies from $T_a \rightarrow T_{b1} \rightarrow T_{b2} \rightarrow T_{b3} \rightarrow T_a \rightarrow T_{c1} \rightarrow T_{c2} \rightarrow T_{c3} \rightarrow T_a$ to present a variation in shape of a flying object such as a winged creature in flight. In the embodiment of the present invention illustrated in the drawings, the rate of flappings of the wings of the bird of prey is 300 per minute, with a total of 10 flappings per flight over a vertical distance of 50 centimeters across the screen.

I claim as my invention:

1. A light-emission gun amusement machine including a light emission gun, a photosensor element, a light source, a screen, a mirror interposed therebetween to refect the light beam from said light source onto said screen and thereby to produce a target mark thereon, which comprises a mirror drive system consisting of a mirror vertical drive mechanism including a driving shaft connected to a constantly revolving shaft connected to an electric motor in such a manner that said mirror is kept tilting back and forth throughout the rotation of said electric motor and a mirror horizontal drive mechanism including a driving shaft disconnectably associated with said constantly revolving shaft via a one-way clutch operable only in a normal direction of the motor, whereby said mirror is driven horizontally only during the rotation in normal direction of said electric motor, and a motor power supply control device including a switching mechanism for reversing the electrical connection between the motor and a power supply upon generation of an output signal by said photosensor element actuated by said light emission gun to reverse the rotational direction of said electric motor, whereby said target mark is caused to move diagonally in a composite direction made up of horizontal and vertical component directions on the screen by and during a normal rotation of the motor to simulate a flight of a prey and said mark is caused to move only vertically downwardly upon suspension of the horizontal drive of said mirror as the motor is driven in reverse in response to the generation of said output signal to thereby simulate a fall of said prey.

2. A light-emission gun amusement machine as set forth in claim 1 wherein said revolving shaft for said mirror vertical drive mechanism carries, as rigidly mounted thereon, a cam adapted to act upon a switch interposed in an electric circuit for the light source for generating said mark on the screen when tilting said mirror to cause the target mark to ascend across the screen, whereby the light source is switched off when the mirror vertical drive mechanism starts displaying a descending action of said mark so that the mark is caused only to ascend in its normal flight to provide a clear distinction from the fall of the mark which is caused by a successful shooting of the mark with said weapon.

3. A light-emission gun amusement machine including a light emission gun, a photo sensor element, a light source, a screen, a mirror interposed therebetween to refect the light beam from said light source onto said screen and thereby to produce a target mark thereon, which comprises a mirror drive system consisting of a mirror vertical drive mechanism including a driving shaft connected to a constantly revolving shaft connected to an electric motor in such a manner that said mirror is kept tilting back and forth throughout the rotation of said electric motor and a mirror horizontal drive mechanism including a driving shaft disconnectably associated with said constantly revolving shaft via a one-way clutch operable only in a normal direction of the motor, whereby said mirror is driven horizontally only during the rotation in normal direction of said electric motor, and a motor power supply control device including a switching mechanism for reversing the electrical connection between the motor and a power supply upon generation of an output signal by said photosensor element actuated by said light emission gun to reverse the rotational direction of said electric motor, a hitting-sound emission device including a resonance box, a vibrating member, one end of which is rigidly secured to said resonance box, a serrated plate having a toothed periphery adapted to engage a free end of said vibrating member and, upon rotation, to vibrate said vibrating plate, and a one-way clutch adapted to allow said serrated plate to engage a constantly revolving shaft upon reversal of the rotation of said electric motor, whereby said mark is caused to move diagonally in a composite direction made up of horizontal and vertical component directions across the screen during a normal rotation of the electric motor to simulate a flight of a prey and the rotation of said motor is reversed upon a successful shooting of the mark with said weapon to suspend the horizontal drive of said mirror to cause the mark to move only vertically downwardly and, thereby, to simulate a fall of said prey and, at the same time, to cause said hitting-sound emission device to produce a sound simulating a cry or cries of the prey.

4. A light-emission gun amusement machine including a light emission gun, a photosensor element, a light source, a screen, a mirror interposed therebetween to reflect the light beam from said light source onto said screen and thereby to produce a target mark thereon, which comprises a mirror drive system consisting of a mirror vertical drive mechanism including a driving shaft connected to a constantly revolving shaft connected to an electric motor in such a manner that said mirror is kept tilting back and forth throughout the rotation of said electric motor and a mirror horizontal drive mechanism including a driving shaft disconnectably associated with said constantly revolving shaft via a one-way clutch operable only a normal direction of the motor, whereby said mirror is driven horizontally only during the rotation in normal direction of said electric motor, and a motor power supply control device including a switching mechanism for reversing the electrical connection between the motor and a power supply upon generation of an output signal by said photosensor element activated by said light emission gun to reverse the rotational direction of said electric motor, a diaphragm device including a stationary plate having a mark aperture consisting of a basic configured area and an extension configured area, a movable diaphragm member plate having a shutter member adapted to block the light passing through said extension configured area of mark aperture and such that the effective area of release of the blocking of light gains from a minimum to a maximum and, then, declines from said maximum to said minimum and that said release of blocking starts and ends at the portion of said extension configured area that is adjacent said basic configured area, and a cam for driving said diaphragm member plate of said diaphragm device, said cam being connected to a constantly revolving shaft via a one-way clutch which transmits only a normal revolution of said electric motor, whereby said mark is caused to move in a composite direction made up of horizontal and vertical components across said screen during a normal rotation of said electric motor to simulate a flight of a prey and the rotation of said motor is reversed upon a successful shooting of the mark with said weapon to suspend the horizontal drive of said mirror to cause the mark to move only vertically downwardly and, thereby, to simulate a fall of said prey, the configuration of the prey being changed only during its normal flight but retaining a fixed configuration during its downward flight to make a clear distinction between a successful shooting and an unsuccessful shooting.

5. A light-emission gun amusement machine as set forth in claim 4, wherein said stationary plate has a plurality of extension configured areas, in stead of one, on both sides of said basic configured area.

6. A light-emission gun amusement machine including a light emission gun, a photosensor element, a light source, a screen, a mirror interposed therebetween to refect the light beam from said light source onto said screen and thereby to produce a target mark thereon, which comprises a mirror drive system consisting of a mirror vertical drive mechanism including a driving shaft connected to a constantly revolving shaft connected to an electric motor in such a manner that said mirror is kept tilting back and forth throughout the rotation of said electric motor and a mirror horizontal drive mechanism including a driving shaft disconnectably associated with said constantly revolving shaft via a one-way clutch operable only in a normal direction of the motor, whereby said mirror is driven horizontally only during the rotation in normal direction of said electric motor, and a motor power supply control device including a switching mechanism for reversing the electrical connection between the motor and a power supply upon generation of an output signal by said photosensor element activated by said light emission gun to reverse the rotational direction of said electric motor, a score display device including a rotary display plate as disconnectably connected to a constantly revolving shaft via a one-way clutch operable in a reverse direction of rotation thereof and an indexing unit, whereby said mark is caused to move in a composite direction made up of horizontal and vertical component directions across the screen during a normal rotation of the electric motor to simulate a flight of a prey, the rotation of said motor is reversed upon a successful shooting of the mark with said weapon to suspend the horizontal drive of said mirror to cause the mark to move only vertically downwardly and, thereby, to simulate a fall of said prey and the total number of successful shootings is cumulatively displayed.

* * * * *